US008823592B2

(12) United States Patent
Huynh

(10) Patent No.: US 8,823,592 B2
(45) **Date of Patent: *Sep. 2, 2014**

(54) ANTENNA ARRAY WITH CAPACITIVE COUPLED UPPER AND LOWER ANTENNA ELEMENTS AND A PEAK RADIATION PATTERN DIRECTED TOWARD THE LOWER ANTENNA ELEMENT

(71) Applicants: Sony Mobile Communications AB, Lund (SE); Sony Corporation, Tokyo (JP)

(72) Inventor: Minh-Chau Huynh, Foster City, CA (US)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 0 days.

This patent is subject to a terminal disclaimer.

(21) Appl. No.: 13/711,979

(22) Filed: Dec. 12, 2012

(65) Prior Publication Data

US 2013/0099986 A1 Apr. 25, 2013

Related U.S. Application Data

(63) Continuation of application No. 12/777,718, filed on May 11, 2010, now Pat. No. 8,354,967.

(51) Int. Cl.
*H01Q 1/24* (2006.01)

(52) U.S. Cl.
USPC ..... 343/702; 343/700 MS

(58) Field of Classification Search
USPC ..... 343/700 MS, 702, 846, 848
See application file for complete search history.

(56) References Cited

U.S. PATENT DOCUMENTS

| | | | | |
|---|---|---|---|---|
| 2009/0073047 | A1 | 3/2009 | Le Bolzer et al. | |
| 2010/0259454 | A1 | 10/2010 | Rahola et al. | |
| 2010/0295737 | A1 | 11/2010 | Milosavljevic et al. | |
| 2011/0175776 | A1 | 7/2011 | Anguera et al. | |
| 2013/0082884 | A1* | 4/2013 | Gummalla | 343/702 |

* cited by examiner

*Primary Examiner* — Hoanganh Le
(74) *Attorney, Agent, or Firm* — Myers Bigel Sibley & Sajovec, P.A.

(57) ABSTRACT

An antenna system includes a substrate, a conductive ground plane, and an upper antenna element. A slot that is free of conductive material extends through the ground plane to define a lower antenna element from a portion of the ground plane. The upper antenna element is spaced apart and overlies at least a portion of the lower antenna element. The upper antenna element is electrically connected to the ground plane and to an antenna feed element. The upper antenna element is configured to electrically resonate responsive to a defined RF signal. The lower antenna element is configured to resonate through capacitive coupling to the resonating upper antenna element.

23 Claims, 7 Drawing Sheets

Farfield 'ff_01.5750 [1]' Gain_Right Polarisation[Theta]; Phi= 90.0 deg.

Farfield 'ff_01.5750 [1]' Gain_Right Polarisation[Theta]; Phi= 0.0 deg.

ANTENNA ARRAY WITH CAPACITIVE COUPLED UPPER AND LOWER ANTENNA ELEMENTS AND A PEAK RADIATION PATTERN DIRECTED TOWARD THE LOWER ANTENNA ELEMENT

CROSS-REFERENCE TO RELATED APPLICATION

The present application is a continuation of U.S. patent application Ser. No. 12/777,718, filed May 11, 2010, the disclosure of which is incorporated herein by reference in its entirety.

BACKGROUND OF THE INVENTION

The present application relates generally to antennas for radio communication devices and, more particularly, to internal antennas and communications terminals employing the same.

Portable radio communications devices, such as mobile terminals, are increasingly packing more circuitry and larger displays and keypads/keyboards within small housings. As a consequence, there has been increased use of semi-planar antennas, such as a multi-branch inverted-F antenna, that may occupy a smaller space within a terminal housing. The semi-planar antenna can be printed on/mounted to the terminal's main printed circuit board, but they are placed away from a ground plane of the terminal's printed circuit board to improve performance. Constraints on the available space and location for the branches of the antenna can negatively affect the antenna performance. For example, many terminals locate the antenna on a lower side of the terminal's printed circuit board when the terminal is held with the display facing upward.

SUMMARY

In some embodiments of the present invention, an antenna system includes a planar substrate, a conductive ground plane, and an upper antenna element. The conductive ground plane is on the substrate. A slot that is free of conductive material extends through the ground plane to define a lower antenna element from a portion of the ground plane. The upper antenna element is spaced apart and overlies at least a portion of the lower antenna element. A first location of the upper antenna element is electrically connected to the ground plane and a spaced apart second location of the upper antenna element is electrically connected to an antenna feed element. The upper antenna element is configured to electrically resonate responsive to a defined RF signal. The lower antenna element is configured to resonate through capacitive coupling to the resonating upper antenna element.

In some further embodiments, the upper antenna element may be configured as a first radiating element of a planar inverted F antenna. The capacitively coupled lower and upper antenna elements may form a two antenna array with a peak radiation pattern in a direction from the upper antenna element toward the lower antenna element.

As will be explained in further detail below, the antenna system may be configured to resonate in a frequency band of signals transmitted by a satellite-based positioning system. When the antenna system is located on a side of a planar substrate, such as a print circuit board, that is facing downward, the peak radiation pattern of the antenna system can advantageously be directed upward to receive signals that are transmitted by the satellite-based positioning system.

The planar substrate may include a printed circuit board. A display screen may be mounted on an opposite side of the printed circuit board from the ground plane. The two antenna array formed by the capacitively coupled lower and upper antenna elements may be configured to have a peak radiation pattern in a direction from the upper antenna element toward the display screen.

A major length of the slot may extend in a direction substantially parallel to the edge of the ground plane to define a major length of the lower antenna element to extend adjacent the edge of the ground plane.

The slot may be L-shaped to define a rectangular shape for the lower antenna element.

A length of the upper antenna element may be configured to cause the upper antenna element and the lower antenna element to resonant in a frequency band of signals transmitted by a satellite-based positioning system.

A length of the slot along the edge of the ground plane may be configured to cause the upper antenna element and the lower antenna element to have a defined phase difference between primary resonant currents therein when excited at the defined resonate RF frequency.

The slot length in a direction along the ground plane edge may be configured so that the phase difference between primary resonant currents in the upper antenna element and the lower antenna element steers the peak radiation pattern of the two antenna array in a direction from the upper antenna element toward the lower antenna element.

The upper antenna element may overlap a substantially rectangular portion of the lower antenna element. The overlaid substantially rectangular portion of the lower antenna element may have a first boundary that is integral (formed from the same layer) to the ground plane and has a distal second boundary that is electrically connected to the first location of the upper antenna element.

The first location may be on an edge region of the upper antenna element and is electrically connected to a second conductive ground plane that is on an opposite side of the planar substrate from the conductive ground plane.

The upper antenna element may extend in a substantially U-shape from the first location through a distant second location and back to a third location that is adjacent the first location.

A distance that the upper antenna element extends from the first location to the distant second location may be configured to cause the upper antenna element to resonant in a frequency band of signals transmitted by a satellite-based positioning system.

The upper antenna element may have a planar surface that is spaced apart from the lower antenna element by no more than 2 mm.

The ground plane may be a first ground plane, a second conductive ground plane may be on an opposite side of the substrate from the first ground plane, and the antenna feed element may extend through the substrate between and without contacting the first and second ground planes.

The capacitively coupled lower and upper antenna elements may form a two antenna array that is tuned to resonant responsive to incident RF signals transmitted by a satellite-based positioning system.

In some other embodiments, a communications device includes a printed circuit board, a display screen, and an upper antenna element. The printed circuit board has a conductive ground plane. A slot that is free of conductive material extends through the ground plane to define a lower antenna element from a portion of the ground plane. The display screen is mounted to an opposite side of the printed circuit board to the lower antenna element. The upper antenna element is spaced apart and overlies at least a portion of the lower antenna element. A first location of the upper antenna element is electrically connected to the ground plane and a spaced apart second location of the upper antenna element is electrically connected to an antenna feed element. The upper antenna element is configured to electrically resonate responsive to incident RF signals transmitted by global positioning system satellites. The lower antenna element is configured to resonate through capacitive coupling to the resonating upper antenna element. The capacitively coupled lower antenna and upper elements form a two antenna array that is tuned to have a peak radiation pattern in a direction from the upper antenna element toward the display screen.

In some further embodiments, the slot may be L-shaped to define a rectangular shape for the lower antenna element.

The slot length in a direction along the ground plane edge may be configured so that the phase difference between primary resonant currents in the upper antenna element and the lower antenna element steers the peak radiation pattern of the two antenna array in the direction from the upper antenna element toward the display screen.

The upper antenna element may extend in a substantially U-shape from the first location through a distant second location and back to a third location that is adjacent to the first location.

The upper antenna element may have a planar surface that is spaced apart from the lower antenna element by no more than 2 mm.

Other antenna systems, communications devices, and/or methods according to embodiments of the invention will be or become apparent to one with skill in the art upon review of the following drawings and detailed description. It is intended that all such additional antenna systems, communications devices, and/or methods be included within this description, be within the scope of the present invention, and be protected by the accompanying claims. Moreover, it is intended that all embodiments disclosed herein can be implemented separately or combined in any way and/or combination.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Figure 1:
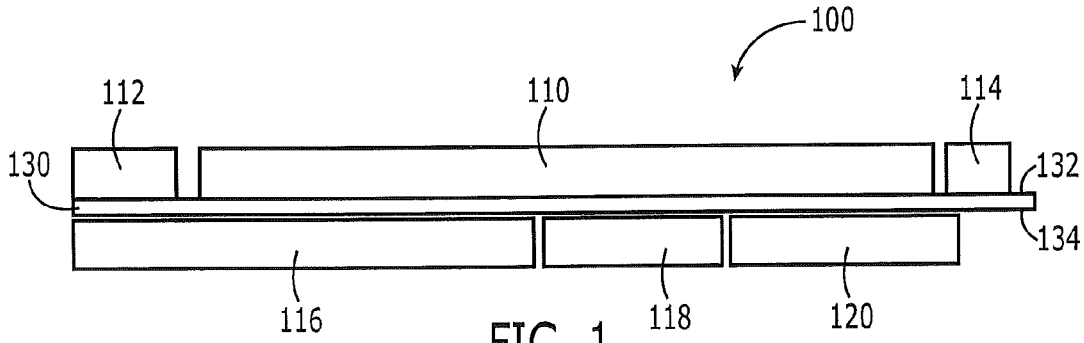
FIG. 1 is a side view of a printed circuit board that includes an antenna system according to some embodiments of the present invention.

The invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, when an element is referred to as being "connected" to another element, it can be directly connected to the other element or intervening elements may be present. In contrast, when an element is referred to as being "directly connected" to another element, there are no intervening elements present. Like numbers refer to like elements throughout.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

Embodiments of the invention are described herein with reference to schematic illustrations of idealized embodiments of the invention. As such, variations from the shapes and relative sizes of the illustrations as a result, for example, of manufacturing techniques and/or tolerances, are to be expected. Thus, embodiments of the invention should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the invention.

For purposes of illustration and explanation only, various embodiments of the present invention are described herein in the context of a wireless communication terminal ("wireless terminal" or "terminal") that includes an antenna system that is configured to receive RF signals transmitted by global positioning system (GPS) satellites and/or other satellite-based positioning systems (e.g., Russia's GLONASS system, China's Beidou system, Europe's Galileo system, India's IRNSS system, and Japan's QZSS system). However, the invention is not limited thereto and may additionally or alternatively be embodied in antenna systems that are configured to carry out cellular communications (e.g., cellular voice and/or data communications), WLAN communications, Bluetooth communications, and/or other RF communications in more than one frequency band.

As used herein, the term "multiband" can include, for example, operations in any of the following bands: GPS and/or other satellite-based positioning systems bands, Advanced Mobile Phone Service (AMPS), ANSI-136, Global Standard for Mobile (GSM) communication, General Packet Radio Service (GPRS), enhanced data rates for GSM evolution (EDGE), DCS, PDC, PCS, code division multiple access (CDMA), wideband-CDMA, CDMA2000, and/or Universal Mobile Telecommunications System (UMTS) frequency bands. For example, GPS operation and include receiving RF signals in the L-band, e.g., 1.1 GHz-1.6 GHz. GSM operation can include reception/transmission in a frequency range of about 824 MHz to about 849 MHz and reception in a frequency range of about 869 MHz to about 894 MHz. EGSM operation can include transmission in a frequency range of about 880 MHz to about 914 MHz and reception in a frequency range of about 925 MHz to about 960 MHz. DCS operation can include transmission in a frequency range of about 1710 MHz to about 1785 MHz and reception in a frequency range of about 1805 MHz to about 1880 MHz. PDC operation can include transmission in a frequency range of about 893 MHz to about 953 MHz and reception in a frequency range of about 810 MHz to about 885 MHz. PCS operation can include transmission in a frequency range of about 1850 MHz to about 1910 MHz and reception in a frequency range of about 1930 MHz to about 1990 MHz. Other bands can also be used in embodiments according to the invention.

FIG. 1 illustrates an exemplary wireless terminal 100 that is configured in accordance with some embodiments. The terminal 100 includes a display screen 110 (e.g., a liquid crystal display), buttons/keypad 112, a speaker 114, a battery 116, radio communications circuitry 118, and an antenna system 120 that are mounted/formed on a printed circuit board (PCB) 130 or other planar substrate. As shown in FIG. 1, the battery 116, the radio communications circuitry 118, and the antenna system 120 are on an opposite side of the PCB 130 from the LCD 110 and other illustrated components due to space constraints.

The PCB 130 can include one or more patterned conductive (e.g., metallization) layers that provide various wiring connections and shielding for one or more components that are mounted on the PCB 130. As shown, a pair of conductive ground planes 132 and 134 may be formed on opposite major surfaces of the PCB 130. The display 110, the speaker 114, and the keypad 112 can be electrically connected to the ground plane 132. The battery 116 and the antenna system 120 can be electrically connected to the other ground plane 134. It will be appreciated that, in some embodiments, the ground planes 132 and 134 may be partially removed in other regions to allow for mounting and connection of other components.

Figure 2:
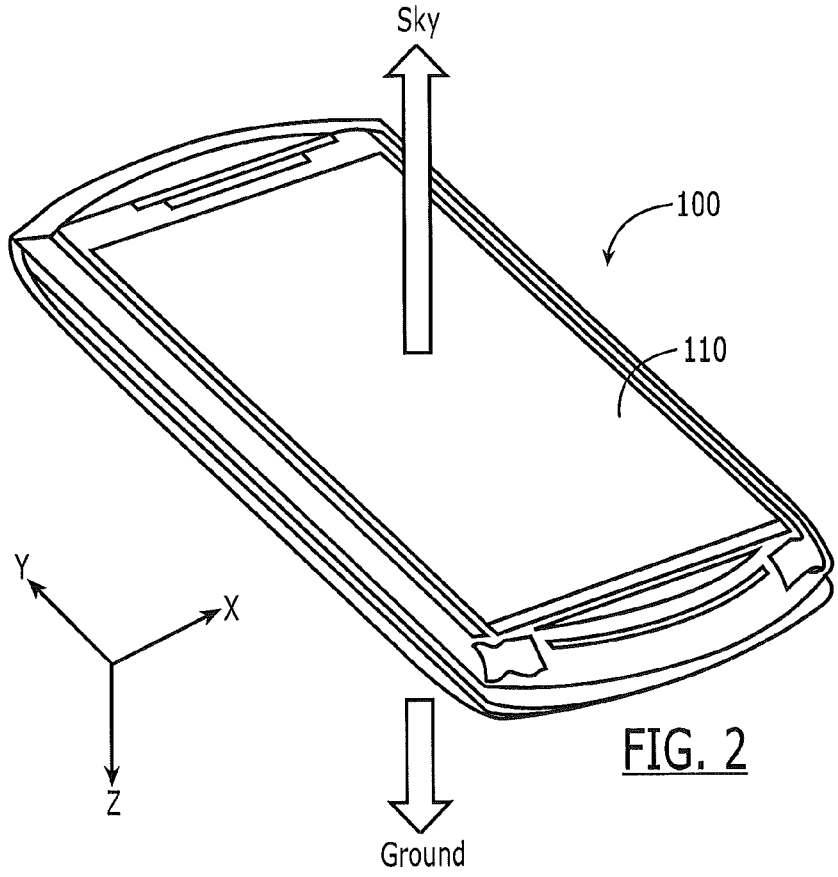
FIG. 2 is a perspective view of a wireless communication terminal that can include the antenna system of FIG. 1.
Figure 3:
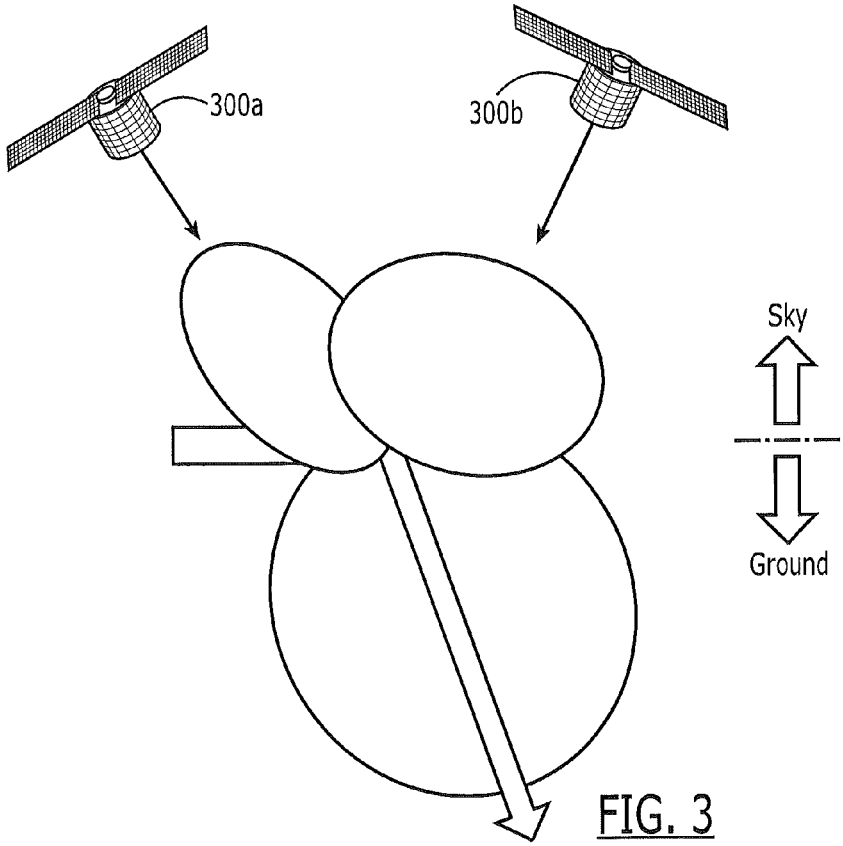
FIG. 3 illustrates a direction of the peak radiation pattern of a conventional antenna system when included in the wireless communication terminal and held in the orientation shown in FIG. 2.

FIG. 2 illustrates a typical orientation of the terminal 100 when a user is viewing the display 110. In that orientation, the antenna system 120 is located underneath the PCB 130 and faces the ground. Some embodiments of the present invention may arise from the present realization that when prior art antenna systems are located underneath the PCB 130, their peak radiation pattern is then directed downward towards the ground, such as shown in FIG. 3. Accordingly, FIG. 3 can illustrate the direction of the peak radiation pattern (illustrated by the downward pointing arrow) of a conventional antenna system. The downward pointing peak radiation pattern can occur because of, for example, interference from the conductive ground planes 132 and 134 and/or circuit components of the display 110, the speaker 114, the keypad 112 and/or other components of the terminal 100.

In some embodiments of the present invention, the antenna system 120 is configured to receive RF signals that are transmitted by global positioning system (GPS) satellites (e.g. satellites 300*a*-300*b* in FIG. 3) and/or other satellite-based positioning systems (e.g., Russia's GLONASS system, China's Beidou system, Europe's Galileo system, India's IRNSS system, and Japan's QZSS system). The downward facing peak radiation pattern provided by at least some conventional antenna systems is pointed in an opposite direction to the incident RF signals from satellites 300*a*-300*b*. To provide improved antenna performance and/or other benefits, the antenna system 120 according to some embodiments of the present invention can have a peak radiation pattern that is directed towards the sky (e.g., through the display 110 in an opposite directions to the arrow shown in FIG. 3) when the terminal 100 is held in the orientation shown in FIG. 2.

Figure 4:
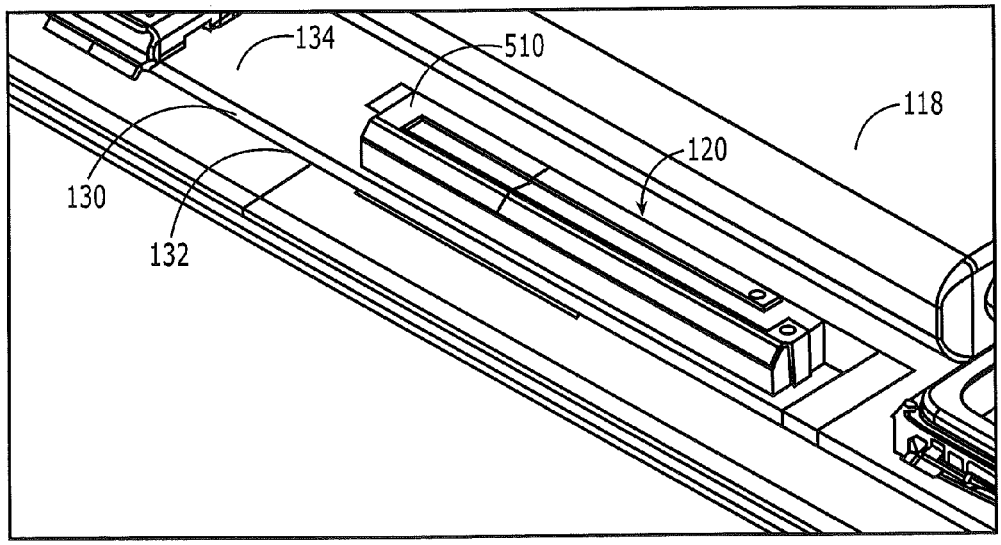
FIG. 4 is a perspective view of an antenna system according to some embodiments of the present invention.

FIG. 4 shows a perspective view of the antenna system 120 according to some embodiments of the present invention. For ease of illustration, the PCB 130 is flipped in FIG. 4 relative to the orientation shown in FIG. 2 so that the antenna system 120 is on an upper surface and the display 110 is on a lower surface. Referring to FIG. 4, the antenna system 120 is electrically connected to radio communications circuitry 118. The radio communication circuitry 118 can be configured to demodulate and decode signals received by the antenna system 120 from GPS satellites and/or other RF transmitter sources.

In some embodiments, the radio communication circuitry 118 and/or other circuitry of the terminal 100 is configured to function as a GPS receiver that receives and determines a geographic location of the terminal 100 responsive to GPS signals. The radio communication circuitry 118 may alternatively or additionally be configured to encode and modulate information for transmission as a RF signal through the antenna system 120. Accordingly, the radio communication circuitry 118 and/or other circuitry of the terminal 100 may configured to communicate bi-directionally according to one or more cellular standards, such as Global Standard for Mobile (GSM) communication, General Packet Radio Service (GPRS), enhanced data rates for GSM evolution (EDGE), DCS, PDC, PCS, code division multiple access (CDMA), wideband-CDMA, CDMA2000, and/or Universal Mobile Telecommunications System (UMTS) frequency bands, according to one or more WLAN standards, and/or according to one or more Bluetooth standards.

Figure 5:
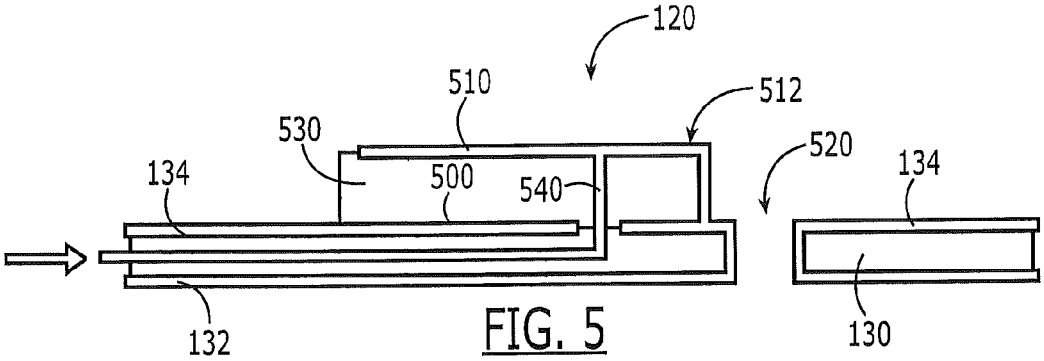
FIG. 5 is a side cross-sectional view of the antenna system of FIG. 4 according to some embodiments of the present invention.
Figure 6:
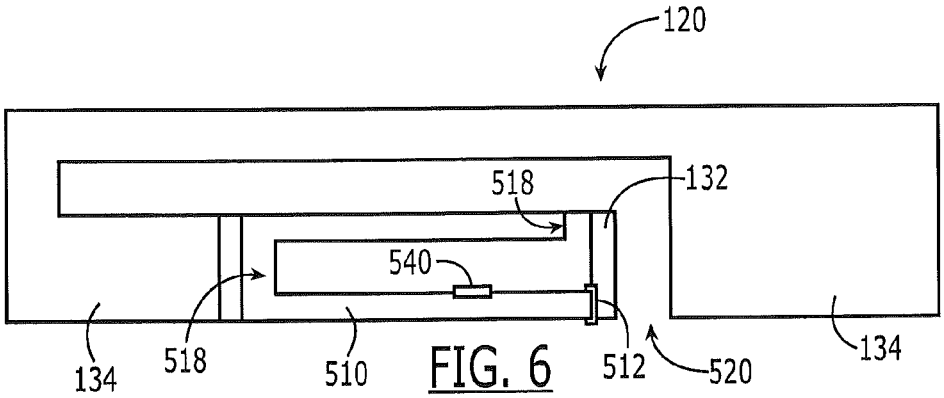
FIG. 6 is a top view of the antenna system of FIG. 4 according to some embodiments of the present invention.
Figure 7:
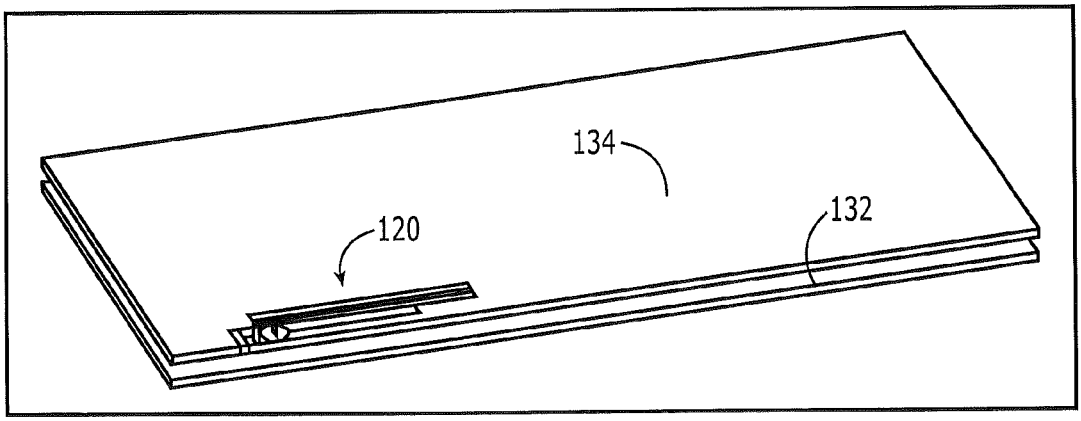
FIG. 7 is a simplified perspective view of the antenna system of FIG. 4 according to some embodiments of the present invention.

FIG. 5 is a side cross-sectional view and FIG. 6 is a top view of the antenna system 120 of FIG. 4 according to some embodiments of the present invention. FIG. 7 is a simplified perspective view of the antenna system of FIG. 4 showing the conductive ground planes 132, 134 and the antenna structure 120 according to some embodiments of the present invention, while other components of FIG. 4 have been omitted for ease of visualization.

Referring to FIGS. 4, 5, 6, and 7, the antenna system 120 includes a lower antenna element 500 and an upper antenna element 510. The lower antenna element 500 is defined by a slot 520 that extends through the conductive ground plane 134 to be free of conductive material, and may extend entirely through the PCB 130 as shown in FIGS. 5 and 6. The lower antenna element 500 is therefore formed from a portion of the conductive ground plane 134.

The upper antenna element 510 is spaced apart and overlies at least a portion of the lower antenna element 500. The upper antenna element 510 may be formed on a dielectric element 530 or an air gap may be present between the upper and lower antenna elements 500, 510. The upper antenna element 510 is electrically connected at a first location 512 to the conductive ground plane 132 via a conductive member. A spaced apart second location of the upper antenna element 510 is electrically connected to an antenna feed element 540. The antenna feed element 540 can extend through the PCB 130 between and without contacting the opposing conductive ground planes 132 and 134, such as shown in FIG. 5.

The upper antenna element 510 is configured to electrically resonate responsive to signals in a defined RF frequency band, such as responsive to signals in a frequency band used for transmission by GPS satellites and/or other satellite-based positioning systems. The lower antenna element 500 is configured to resonate through capacitive coupling to the resonating upper antenna element 510. Referring to the cross sectional view of FIG. 5, the upper antenna element 510 can be configured as a first radiating element of a planar inverted F antenna (including the structural interconnection of the planar upper antenna element 510 to the conductive ground plane 132 and the antenna feed element 540).

Because the lower antenna element 500 resonates with capacitive coupling to the resonating upper antenna element 510, the combination can be configured to form a two antenna array with a peak radiation pattern in a direction from the upper antenna element 510 toward the lower antenna element 500. Accordingly, referring to FIGS. 2, 4 and 7, the peak radiation pattern of the antenna system 120 can be configured to be in a direction from the upper antenna element 510 through the PCB 130 and display 110 pointing towards the sky. The antenna system 120 may thereby have substantially improved receiver performance, relative to at least some conventional antenna systems, for receiving communication signals from GPS satellites or other communication sources when the terminal 100 is held with the display 110 facing upward.

In some embodiments, the upper antenna element 510 has a planar surface that is spaced apart from the lower antenna element 500 by no more than 2 mm so that there is sufficient capacitive coupling between the resonating upper and lower antenna elements 510, 500 to cause the peak radiation pattern to be directed from the upper antenna element 510 toward the lower antenna element 500. More particularly, it has been determined that a spacing of no more than two millimeters can cause the lower and upper antenna elements 500, 510 to form an antenna array with a peak radiation pattern that can be effectively steered to be in a desired direction by controlling the major length of the slot 520 and the length of the upper antenna element 510.

Referring to FIGS. 4, 5, and 6, the slot 520 can be L-shaped to define a rectangular shape for the lower antenna element 500. A major length of the slot 520 can extend in a direction that is substantially parallel to an edge of the ground plane 134 to define the lower antenna element 500 as extending adjacent to the edge of the ground plane 134.

Referring to FIG. 6, the upper antenna element 510 can extend in a substantially U-shape from the first location 512 through a distant second location 516 and back to a third location 518 that is adjacent to the first location 512. As will be appreciated, the distance between the second and third locations 516, 518 may be shorter so that the upper antenna element 510 has a substantially J-shape or L shape. The length of the upper antenna element 510 from the first location 512 to the distal third location 518 affects the resonant frequency of the upper antenna element 510 and, thereby, the resonant frequency of the capacitively coupling lower antenna element 500. Accordingly, the length of the upper antenna element 510 can be tuned so that the lower and upper antenna elements 500, 510 will resonate in a defined RF resonant frequency, such as within one or more of the frequency bands described herein. The resonance may occur due to signals that have been transmitted by a remote signal source (e.g., signal reception) and/or due to a signal that provided through the antenna feed element 540 to the upper antenna element 510 (e.g., signal transmission).

A length of the upper antenna element 510 affects the resonant frequency of the lower and upper antenna elements 500, 510. Accordingly, the length of upper antenna element 510 can be tuned to cause the upper antenna element 510 and the lower antenna element 500 to resonate at a defined resonant RF frequency, such as within the frequency band of signals transmitted by GPS satellites and/or other particular types of RF signal sources.

A length of the slot 520 affects the phase difference between primary resonant currents in the lower and upper antenna elements 500, 510 when they are excited at a defined resonate RF frequency. Accordingly, the slot 520 length can be tuned to cause the upper antenna element 510 and the lower antenna element 500 to have a defined phase difference between their primary resonant currents. The phase difference can thereby be defined so that the antenna array provided by the lower and upper antenna elements 500, 510 is steered so that its peak radiation pattern is in a direction from the upper antenna element 510 toward the lower antenna element 500 and, thereby, directed towards the sky when the terminal 100 is oriented so that the display 110 is facing the sky.

Referring to FIG. 5, the antenna feed element 540 can extend through the PCB 130 between and without contacting the opposing conductive ground planes 132 and 134.

It will be appreciated that certain characteristics of the components of the lower and upper antenna elements 500, 510 and/or the slot 520, such as, for example, the widths of the lower and upper antenna elements 500, 510 and/or the slot 520 and the curvature of the bends thereof, may vary within the scope of the present invention. Structures, such as brackets, standoffs or intervening insulating material regions, may be used to maintain spacing between the upper antenna element 510 and the lower antenna element 500.

FIGS. 8-12 illustrate graphs of various exemplary radiation patterns that may advantageously be obtained when using an antenna system that is configured in accordance with least one embodiment of the present invention. In FIGS. 8, 9, 11, and 12, reference is made to an X, Y, Z coordinate plane where Z extends downward perpendicular to the screen 110 shown in FIG. 2, and X and Y are perpendicular to each other to form a plane that is parallel to the plane of the PCB 130.

Figure 8:
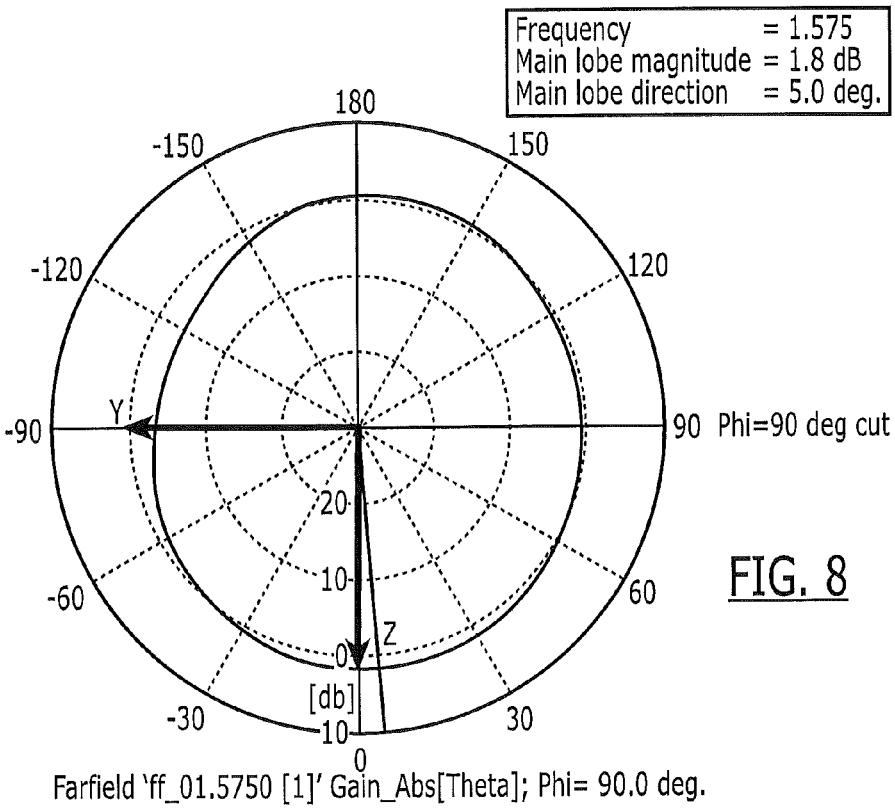
FIG. 8 is a radiation pattern along a Y-Z plane for an exemplary antenna system according to some embodiments of the present invention.
Figure 9:
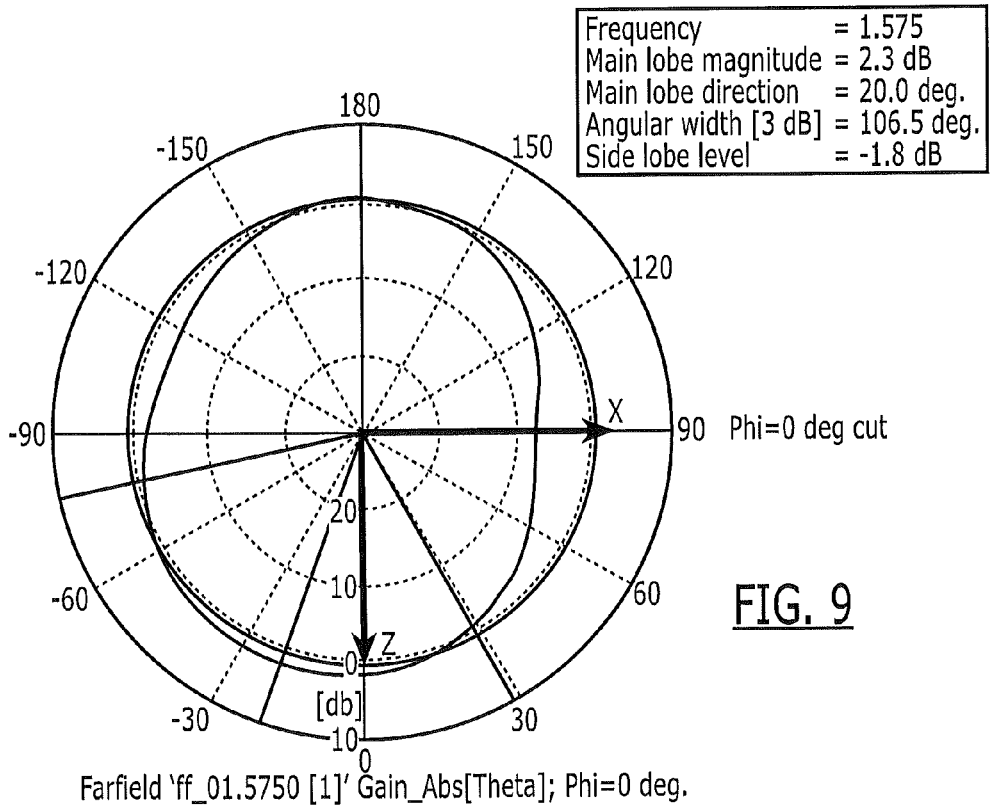
FIG. 9 is a radiation pattern along an X-Z plane for the exemplary antenna system according to some embodiments of the present invention.

FIG. 8 shows an exemplary absolute-polarized radiation pattern that may be exhibited by an antenna system along the Y-Z plane, although the antenna system 120 is not limited thereto. FIG. 9 shows an exemplary absolute-polarized radiation pattern that may be exhibited by the antenna system along the X-Z plane, although the antenna system 120 is not limited thereto. The exemplary radiation patterns of FIGS. 8 and 9 exhibit a desirable substantially omnidirectional pattern for an absolute-polarized signal (not right-hand or left-hand circular polarized) irrespective of the terminal 100 facing upward or downward. Accordingly, the exemplary antenna system can be effectively receive or transmit absolute-polarized signals, such as cellular communication signals, WLAN signals, and/or Bluetooth signals substantially independent of the orientation of the antenna system.

Figure 11:
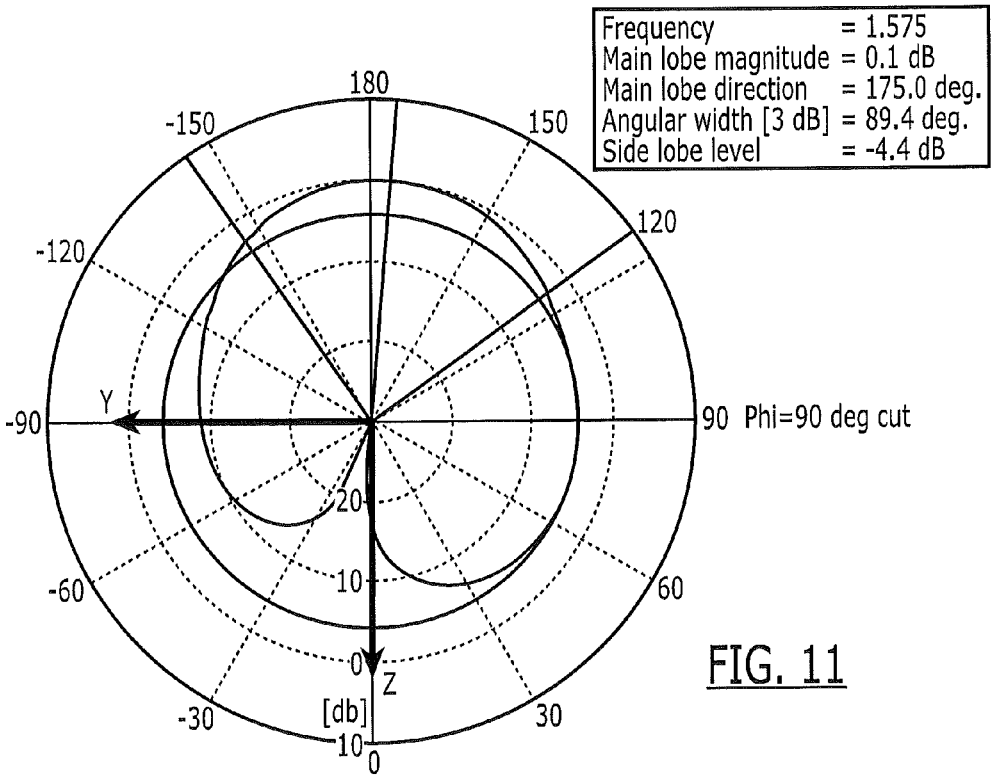
FIG. 11 is a radiation pattern along an Y-Z plane responsive to an incident right-hand circular polarized signal for the exemplary antenna system according to some embodiments of the present invention.
Figure 12:
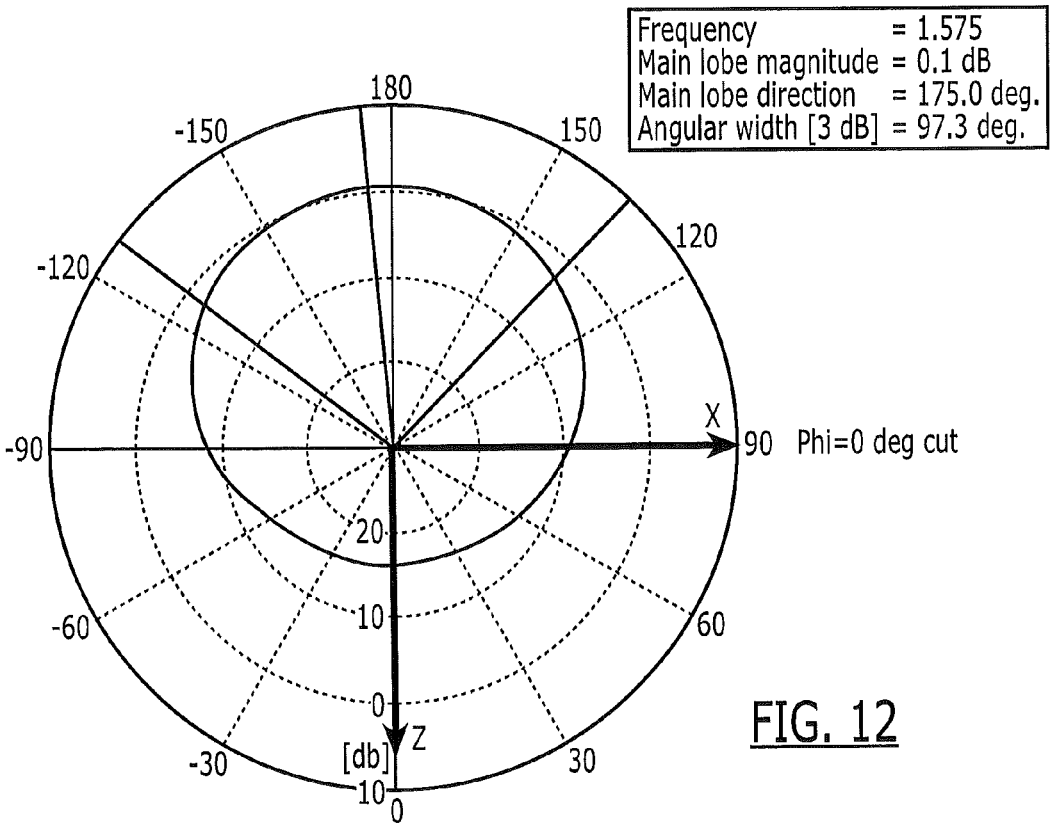
FIG. 12 is a radiation pattern along an X-Z plane responsive to an incident right-hand circular polarized signal for the exemplary antenna system according to some embodiments of the present invention.

FIG. 11 shows an exemplary radiation pattern that may be exhibited by the antenna system along the Y-Z plane responsive to incident right-hand circular polarized signals, although the antenna system 120 is not limited thereto. FIG. 12 shows an exemplary radiation pattern that may be exhibited by the antenna system along the X-Z plane responsive to incident right-hand circular polarized signals, although the antenna system 120 is not limited thereto. Referring to FIG. 11, it is observed that the antenna system exhibits a peak radiation pattern at 180 degrees, which corresponds to the peak radiation pattern pointing upward toward the sky when the display 110 of terminal 100 facing upward toward the sky. Because GPS satellites transmit right-hand circular polarized signals, the exemplary antenna system can be particularly effective at receiving those signals while the terminal 100 is held with the display 110 facing upward.

Figure 10:
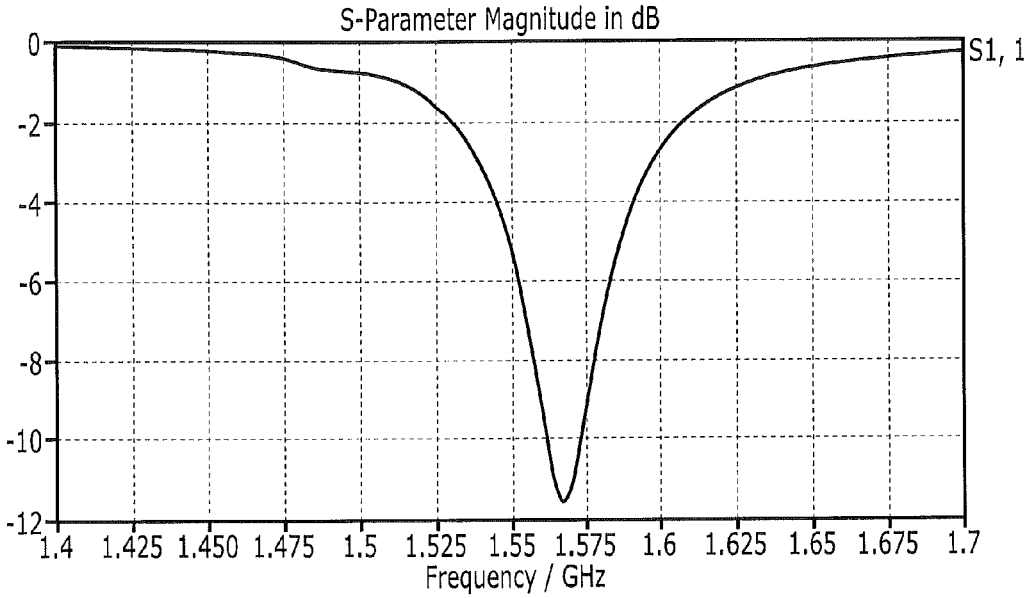
FIG. 10 is a graph of antenna excitation as a function of frequency for the exemplary antenna system according to some embodiments of the present invention.

FIG. 10 is a graph of antenna VSWR (Voltage Standing Wave Ratio) as a function of frequency for an exemplary antenna system according to at least one embodiment of the present invention. Referring to FIG. 10, the exemplary antenna system has been tuned, through, for example, the length of the slot 520 and/or the length of the upper antenna element 510, to resonate around a frequency of 1.57 GHz.

Figure 13:
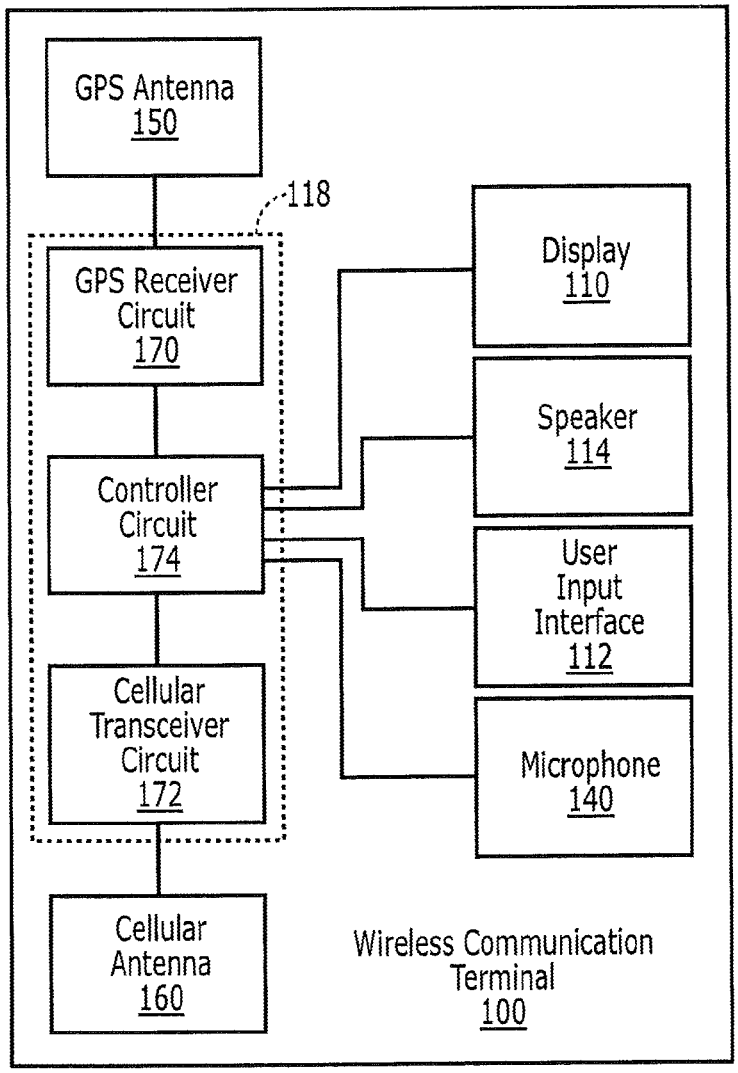
FIG. 13 is a block diagram of some electronic components may be included in the wireless terminal of FIGS. 1 and 2 in accordance with some embodiments.

FIG. 13 is a block diagram of some electronic components that may be included in the wireless terminal 100 of FIGS. 1 and 2 in accordance with some embodiments. Referring to FIG. 13, the exemplary wireless terminal includes the display 110, the speaker 114, the user input interface 112 (e.g., buttons/keys/keypad), a microphone 140, a GPS antenna 150, and a cellular antenna 160. The GPS antenna 150 and/or the cellular antenna 160 may include separate antenna systems or may be combined into a single antenna system in accordance with one or more embodiments of the present invention. The radio communications circuitry 118 may include a GPS receiver circuit 170, a cellular transceiver circuit 172, and a controller circuit 174. The GPS receiver circuit 170 may be configured to receive signals transmitted by GPS satellites and/or another space-based location system. The cellular transceiver circuit 172 may be configured to receive and transmit signals according to one or more cellular standards. The controller circuit 174 may be configured to decode signals received by the GPS receiver circuit 170 and/or to decode/encode signals received/transmitted by the cellular transceiver circuit 172.

Many variations and modifications can be made to the embodiments without substantially departing from the principles of the present invention. All such variations and modifications are intended to be included herein within the scope of the present invention, as set forth in the following claims.

What is claimed is:

1. An antenna system comprising:

a conductive ground plane, wherein a slot that is free of conductive material extends through the ground plane to define a lower antenna element from a portion of the ground plane; and an upper antenna element that is adjacent to the lower antenna element, wherein the upper antenna element is electrically connected to the ground plane and to an antenna feed element, wherein the upper antenna element is configured to electrically resonate responsive to a defined radio frequency (RF) signal, and the lower antenna element is configured to resonate through capacitively coupling to the resonating upper antenna element.

2. The antenna system of claim 1, wherein:

the upper antenna element is configured as a first radiating element of a planar inverted F antenna; and the capacitively coupled lower and upper antenna elements form a two antenna array with a peak radiation pattern in a direction between the upper and lower antenna elements.

3. The antenna system of claim 2, wherein:

the two antenna array has a peak radiation pattern in a direction from the upper antenna element toward the lower antenna element.

4. The antenna system of claim 1:

wherein the conductive ground plane is on a printed circuit board, further comprising a display screen mounted on an opposite side of the printed circuit board from the ground plane; and wherein the two antenna array formed by the capacitively coupled lower and upper antenna elements has a peak radiation pattern in a direction from the upper antenna element toward the display screen.

5. The antenna system of claim 1, wherein:

a major length of the slot extends in a direction substantially parallel to the edge of the ground plane to define a major length of the lower antenna element as extending adjacent to the edge of the ground plane.

6. The antenna system of claim 5, wherein:

the slot is L-shaped and defines a rectangular shape for the lower antenna element.

7. The antenna system of claim 6, wherein:

a length of the upper antenna element is configured to cause the upper antenna element and the lower antenna element to resonant in a frequency band of signals transmitted by a satellite-based positioning system.

8. The antenna system of claim 6, wherein:

a length of the slot along the edge of the ground plane is configured to cause the upper antenna element and the lower antenna element to have a defined phase difference between primary resonant currents therein when excited at the defined resonate RF frequency.

9. The antenna system of claim 8, wherein:

the slot length in a direction along the ground plane edge is configured so that the phase difference between primary resonant currents in the upper antenna element and the lower antenna element steers the peak radiation pattern of the two antenna array in a direction from the upper antenna element toward the lower antenna element.

10. The antenna system of claim 1, wherein:

the upper antenna element overlies a substantially rectangular shaped portion of the lower antenna element; and the overlaid substantially rectangular portion of the lower antenna element has a first boundary that is integral to the ground plane and has a distal second boundary that is electrically connected to the upper antenna element.

11. The antenna system of claim 10, wherein:

an edge region of the upper antenna element is electrically connected to another conductive ground plane that is spaced apart from the conductive ground plane.

12. The antenna system of claim 10, wherein:

the upper antenna element extends in a substantially U-shape from a first location, where the upper antenna element is electrically connected to the ground plane, through a distant second location and back to a third location that is adjacent to the first location.

13. The antenna system of claim 12, wherein:

a distance that the upper antenna element extends from the first location to the distant second location is configured to cause the upper antenna element to resonant in a frequency band of signals transmitted by a satellite-based positioning system.

14. The antenna system of claim 1, wherein:

the upper antenna element has a planar surface that is spaced apart from the lower antenna element by no more than 2 mm.

15. The antenna system of claim 1, wherein the conductive ground plane is a first ground plane; and further comprising:

a substrate; and a second conductive ground plane; and wherein the first and second ground planes are provided on opposite sides of the substrate, and the antenna feed element extends through the substrate between and without contacting the first and second ground planes.

16. The antenna system of claim 1, wherein:

the capacitively coupled lower and upper antenna elements form a two antenna array that is tuned to resonant responsive to incident RF signals transmitted by a satellite-based positioning system.

17. A communications device comprising:

a printed circuit board with a conductive ground plane, wherein a slot that is free of conductive material extends through the ground plane to define a lower antenna element from a portion of the ground plane;

an upper antenna element that is adjacent to the lower antenna element, wherein the upper antenna element is electrically connected to the ground plane and to an antenna feed element, wherein the upper antenna element is configured to electrically resonate responsive to defined RF signals, and the lower antenna element is configured to resonate through capacitive coupling to the resonating upper antenna element, the capacitively coupled lower and upper antenna elements form a two antenna array that is tuned to have a peak radiation pattern in a direction between the upper and lower antenna elements; and radio communications circuitry that is coupled to receive RF signals from the upper antenna element.

18. The antenna system of claim 17, wherein:

the slot is L-shaped and defines a rectangular shape for the lower antenna element.

19. The antenna system of claim 18, further comprising:

a display screen that is mounted to an opposite side of the printed circuit board to the lower antenna element;

the slot length in a direction along the ground plane edge is configured so that the phase difference between primary resonant currents in the upper antenna element and the lower antenna element steers the peak radiation pattern of the two antenna array in the direction from the upper antenna element toward the display screen.

20. The antenna system of claim 18, wherein:

the upper antenna element extends in a substantially U-shape from the first location through a distant second location and back to a third location that is adjacent to the first location.

21. The antenna system of claim 20, wherein:

the upper antenna element has a planar surface that is spaced apart from the lower antenna element by no more than 2 mm.

22. The antenna system of claim 17, wherein the upper antenna element is configured to electrically resonate responsive to incident RF signals transmitted by global positioning system satellites.

23. The antenna system of claim 17, wherein:

the slot is L-shaped and defines a rectangular shape for the lower antenna element;

a display screen is mounted to an opposite side of the printed circuit board to the lower antenna element; and the slot length is configured to cause a phase difference between primary resonant currents in the upper antenna element and the lower antenna element to steer the peak radiation pattern of the two antenna array in a direction from the upper antenna element toward the display screen.

* * * * *